US006112362A

United States Patent [19]

Parko et al.

[11] Patent Number: 6,112,362

[45] Date of Patent: Sep. 5, 2000

[54] SELF-CLEANING BRUSH

[76] Inventors: Nancy B. Parko; Joy E. Parko, both of 167 Norman Ave., Pleasant Gap, Pa. 16823

[21] Appl. No.: 09/204,475

[22] Filed: Dec. 3, 1998

[51] Int. Cl.[7] ..... A46B 17/06; A45D 24/42

[52] U.S. Cl. ..... 15/169; 15/246; 132/119

[58] Field of Search ..... 15/169, 246; 119/628, 119/629; 132/119

[56] References Cited

U.S. PATENT DOCUMENTS

| | | | |
|---|---|---|---|
| 1,249,334 | 12/1917 | Colchin | 132/119 |
| 2,437,298 | 3/1948 | Heyman | 132/119 X |
| 2,553,242 | 5/1951 | Dombitsky | 15/246 |
| 5,890,255 | 4/1999 | Robinson | 15/246 |

*Primary Examiner*—Mark Spisich

*Attorney, Agent, or Firm*—John E. Vandigriff

[57] ABSTRACT

A brush is combined with a flexible netting that is placed over the brush bristles and pulled downward so that the netting is at the base of the bristles. The netting is flexible so that no guide is needed to place the netting at the base of the bristles. The netting has an outer periphery of elastic material so that the edge of the netting will be drawn around the back surface of the brush, holding the netting in place. The netting may have an opening through which the brush handle is extended, or securing straps may be used to loop around the back of the handle to help secure the netting in place. The straps may be secured together with, for example, snaps, a buckle, or a hook and loop fastener. The netting is removed to clean the brush and then is placed back on the brush to accumulate debris until the brush needs cleaning again. Replacement netting is inexpensive and may be used if a net becomes torn or unusable.

5 Claims, 5 Drawing Sheets

SELF-CLEANING BRUSH

FIELD OF THE INVENTION

The invention relates to hair and grooming brushes, and more particularly to a self-cleaning brush that utilizes a removable flexible netting applied over the brush with the netting at the base of the brush bristles.

BACKGROUND OF THE INVENTION

Self-cleaning brushes have been made which are equipped with a means for removing foreign material from the brush and bristles.

A brush, for example, a hair brush, tends to pick up foreign materials such as hair, debris, etc. which have to he removed from the brush bristles periodically by means of suitable means such, as, for example, another brush, or a comb. It is rather time-consuming and is often inconvenient to remove such foreign materials in such conventional manner.

There have been proposed a number of so-called self-cleaning brushes which are equipped with means to remove such foreign materials from bristles, and these have been employed to some extent. For example, U.S. Pat. No. 2,529,927 issued Nov. 14, 1950 to H. W. Fisk and U.S. Pat. No. 2,916,757 issued Dec. 15, 1959 to L. R. Peilet et al disclose a mobile cleaning plate whose relative movement to the brush body is limited. The cleaning plates are lifted by fingers while retaining their respective brush bodies. U.S. Pat. No. 2,916,756 issued Dec. 15, 1959 to L. R. Peilet et al discloses a double acting self-cleaning retractable brush. Referring to FIGS. 1 and 2 of the patent, for cleaning purposes, the upper housing member 18 is turned in one direction. By this action, the bristle carrying member 22 descends within the lower housing member 20 while rotating with the upper housing member 18, thus allowing a compact structure.

U.S. Pat. No. 2,660,183 issued Nov. 24, 1953 to A. Gruring also discloses a self-cleaning brush. The bristles supporting plate 30 and comb supporting plate 32 are raised or lowered by means of the respective control screws 20 and 22. The cover plate 50, which defines a plurality of apertures there through, is integral with the handle body or casing 10 and therefore is stationary. The bristles 40 and combs 42 can be retracted within the handle body or casing 10.

The self-cleaning brushes disclosed in U.S. Pat. Nos. 2,916,756 and 2,916,757 do not contain any locking mechanism which is adapted to retain the bristles in place when the brushes are in use for normal brushing purposes. Accordingly, the cleaning plates may move during the course of the use of the self-cleaning brushes, thus hampering the brushing application.

The self-cleaning brush according to the Invention disclosed in U.S. Pat. No. 2,529,927 includes a locking mechanism which normally retains the cleaning plate in a locked position. The cleaning plate is, however, mobile, and the bristles are normally exposed. In order to clean the bristles, the hooks 13 have to be first released from their locked position one by one. This is rather slow and cumbersome.

According to the drawings of U.S. Pat. No. 2,660,183, and particularly FIGS. 3 to 6, a bristle or comb supporting plate is attached to the free end of its respective screw. A firm attachment would cause the supporting plate to move with difficulty, and a loose attachment would render it unstable and susceptible of breakage.

Another example of a self-cleaning brush is disclosed in U.S. Pat. No. 3,110,053, issued Nov. 12, 1963, to E. C. Surabian. Surabian provides a foraminous cleaning plate (18) through which the bristles (12) of the brush pass. This plate is normally held against the under surface on the back or the brush by spring members (26,28). Plate (18) has a central post (22) projecting upwardly through an aperture in the back of the brush, and one end of each of the springs is fitted into a notch on the upper end of the post (22). By pushing down on the springs the plate (20) with the post (22) is pushed outwardly toward the ends of the tufts of bristles, permitting cleaning of the brush, and when the pressure on the springs is released they revert to their normal arcuate positions, thus causing retraction of the foraminous cleaning plate. Since the cleaning plate (20) is mobile, the bristles are exposed; due to the use of spring members, the manufacturing cost would be rather high and it would be susceptible of breakage.

In U.S. Pat. No. 4,517,703, to Eric J. Kole, to a self-cleaning brush in which the bristles of the brush can be retracted within apertures formed through the anterior wall of the brush to remove foreign materials such as hair, debris, etc., and the bristles can be readily held in place when the brush is in use for normal brushing purposes. However, a cleaning plate 19 and a guide plate 17 are required. The locking plate must be used to hold the bristles in place so that the cleaning plate can be placed back over the bristles.

SUMMARY OF THE INVENTION

The self-cleaning brush of the invention is a brush combined with a flexible netting that is placed over the brush bristles and pulled downward so that the netting is at the base of the bristles. The netting is flexible so that no guide is needed to place the netting at the base of the bristles. The netting has an outer periphery of elastic material so that the edge of the netting will be drawn around the back surface of the brush, holding the netting in place. The netting may have an opening through which the brush handle is extended, or securing straps may be used to loop around the back of the handle to help secure the netting in place. The straps may be secured together with, for example, snaps, a buckle, or a hook and loop fastener.

DESCRIPTION OF A PREFERRED EMBODIMENT

Figure 1:
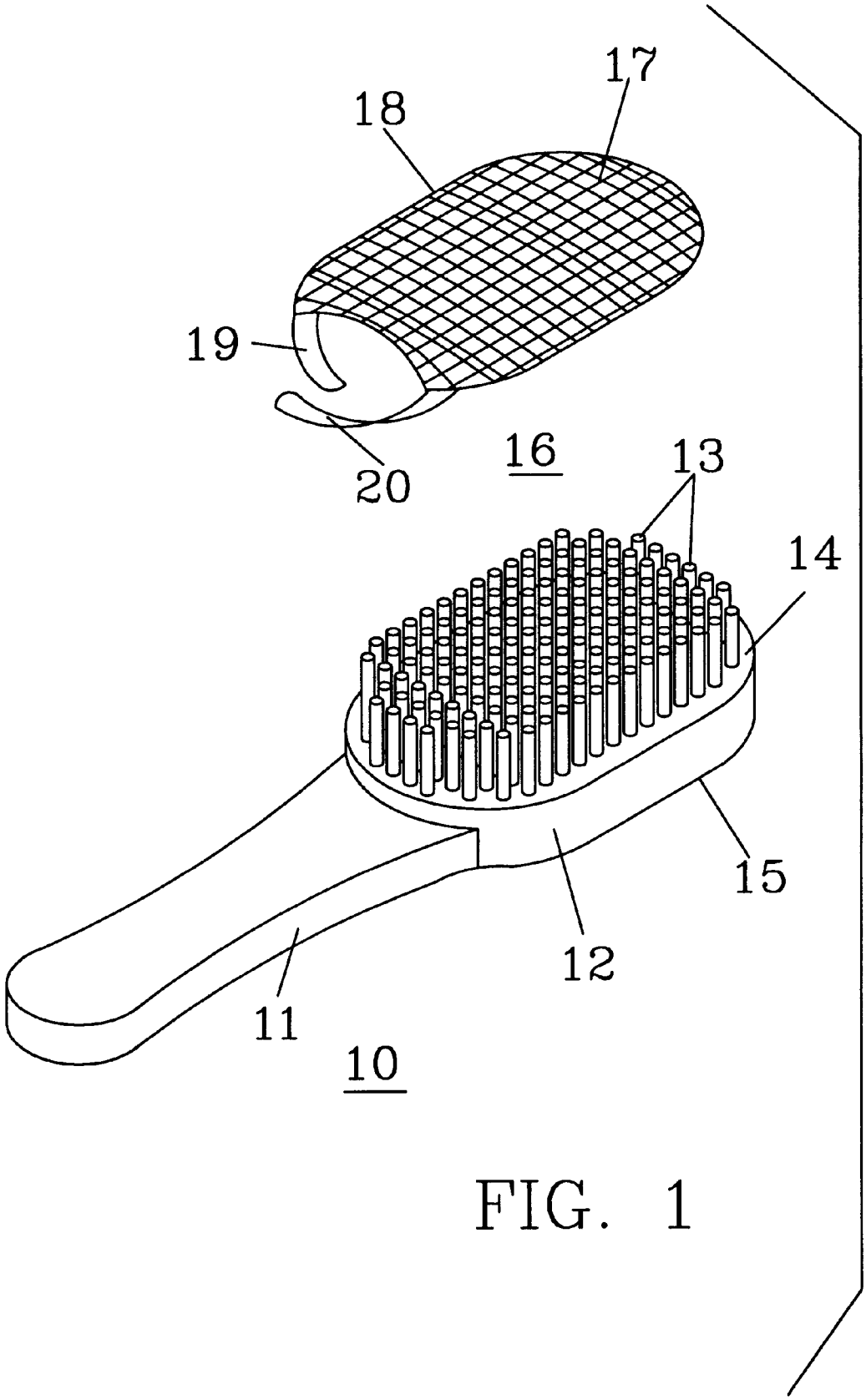
FIG. 1 shows a brush and cleaning netting.

FIG. 1 shows an embodiment of the invention which includes a brush 10 having a main body 12. Body 12 has a brush side 14 and a back side 15. There are a plurality of brush bristles 13 on the brush side of body 12. Handle 11 extends outward from body 12.

Positioned above brush 10 is a netting 16 which is made up of the netting body 17 having a plurality of crossed threads that are held together at the periphery of net 16 by an elastic band 18. Two straps 19 and 20 are secured to one end of net 16, and are used to help secure net 16 to brush 10.

Figure 2:
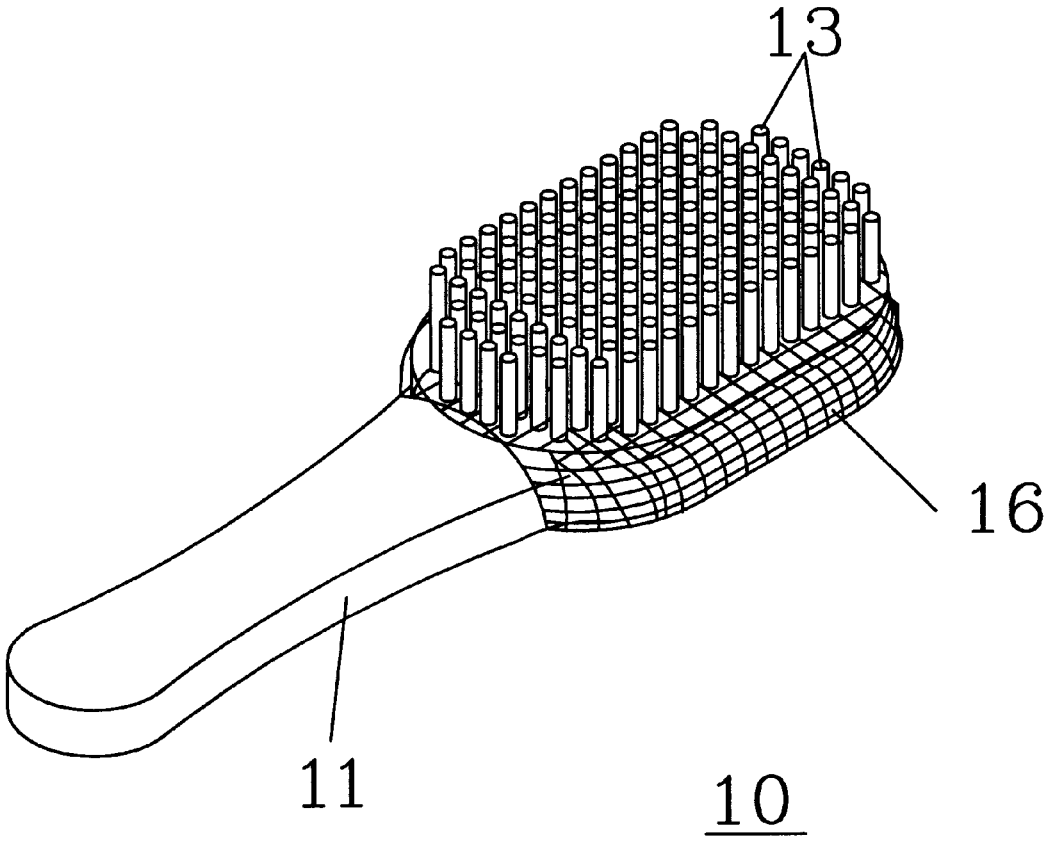
FIG. 2 shows the cleaning netting on the brush.

Net 16 and brush 10 are shown together in FIG. 2. Net 16 has been placed over brush 10 and the net strands 17 have been pulled down between bristles 13 to reside against the surface 14 of brush 10. The outer periphery 18 of net 16 is pulled down and around the bottom, or backside, 15 of brush 10. Straps 19 and 20 (FIG. 1) are wrapped around handle 11 and fastened together by, for example, a buckle, snap or hook and loop fastener. Since net strands 17 are elastic or movable, they can be pulled down between bristles 13 without difficulty, and without a guide plate. Net 16 will accommodate many brushes, and the spacing of the bristles 13 does not matter. To clean brush 10, net 16 is removed, removing any dirt, hair or other foreign matter from brush 10. Net 16 then may be cleaned, or replaced and put back on brush 10.

Figure 3:
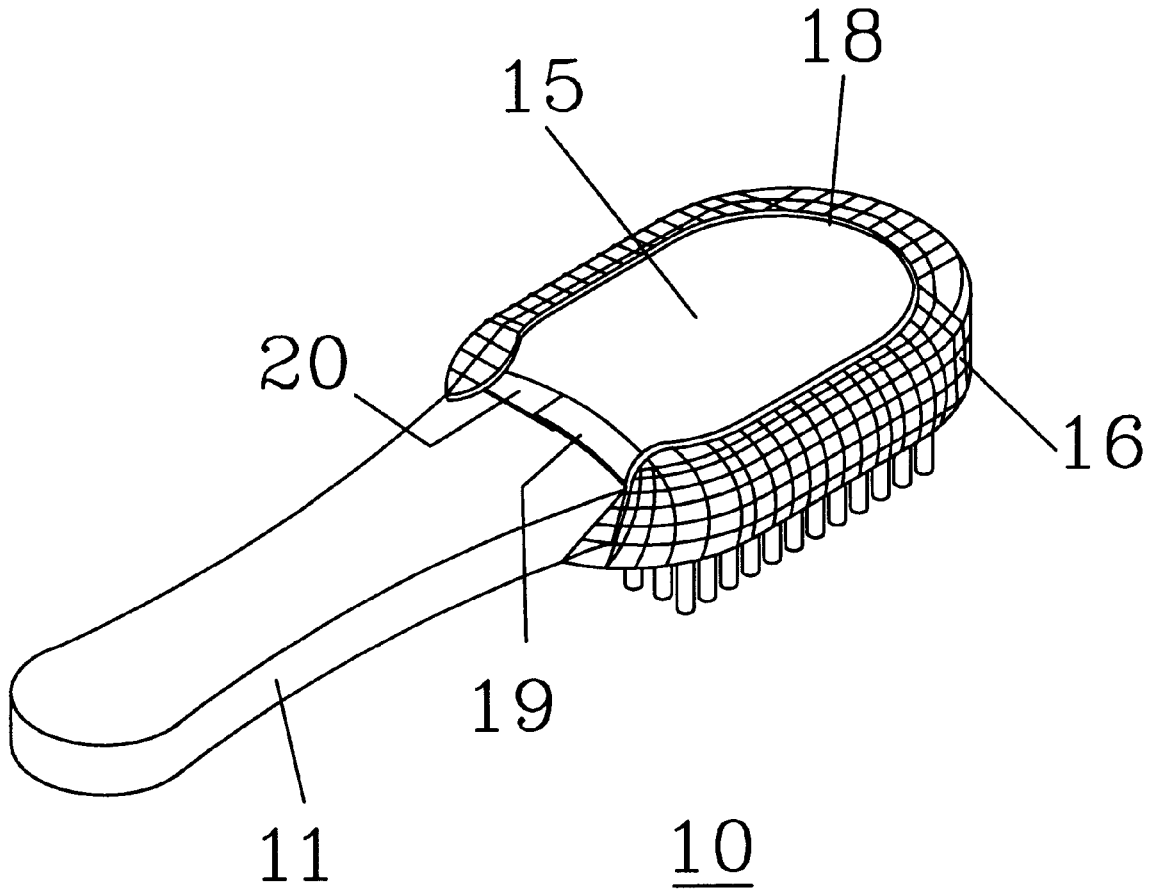
FIG. 3 shows the back side of the brush with netting mounted.

FIG. 3 shows the back side of brush 10. Net 16 is shown pulled around the back side 15 of brush 10, and elastic band 18 holds net 16 on brush 10. Straps 19 and 20 are secured around the back of brush 10 where handle 11 is joined to back 15.

Figure 4:
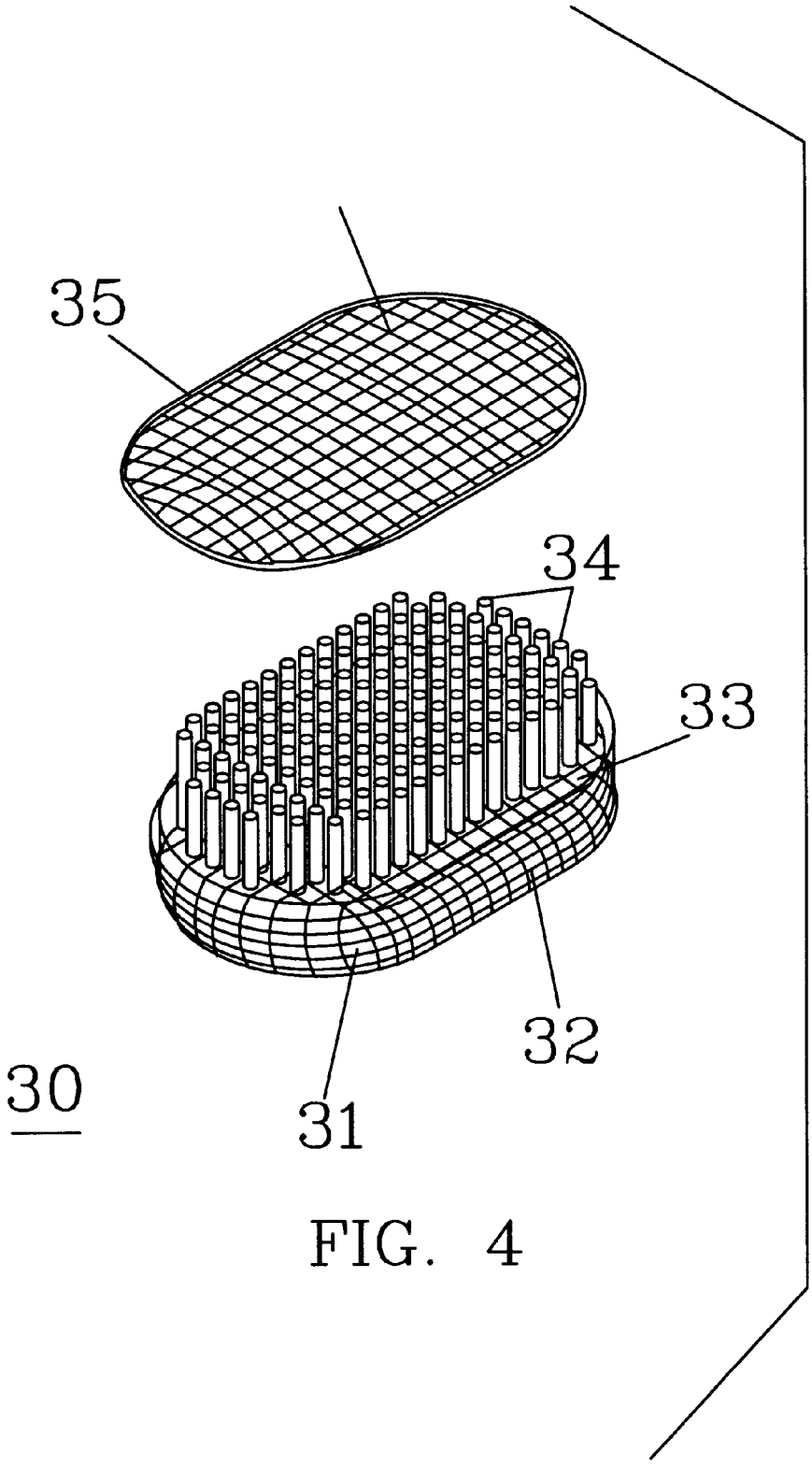
FIG. 4 show a different brush and netting configuration.

FIG. 4 shows an embodiment of the invention utilizing a brush without an extended handle. Brush 30 has a base 31 with bristle surface 33 having a plurality of bristles 34 extending out of surface 33. Net 32 has an elastic band 35 around its periphery which holds net 32 down against surface 33 between bristles 34 and around the edges and backside of brush 30 similar to that shown in FIG. 3 for brush 10. Elastic band 35 completely encircles net 32, and net 32 does not need straps similar to straps 19 and 20 (FIG. 3) to hold net 32 in place.

Figure 5:
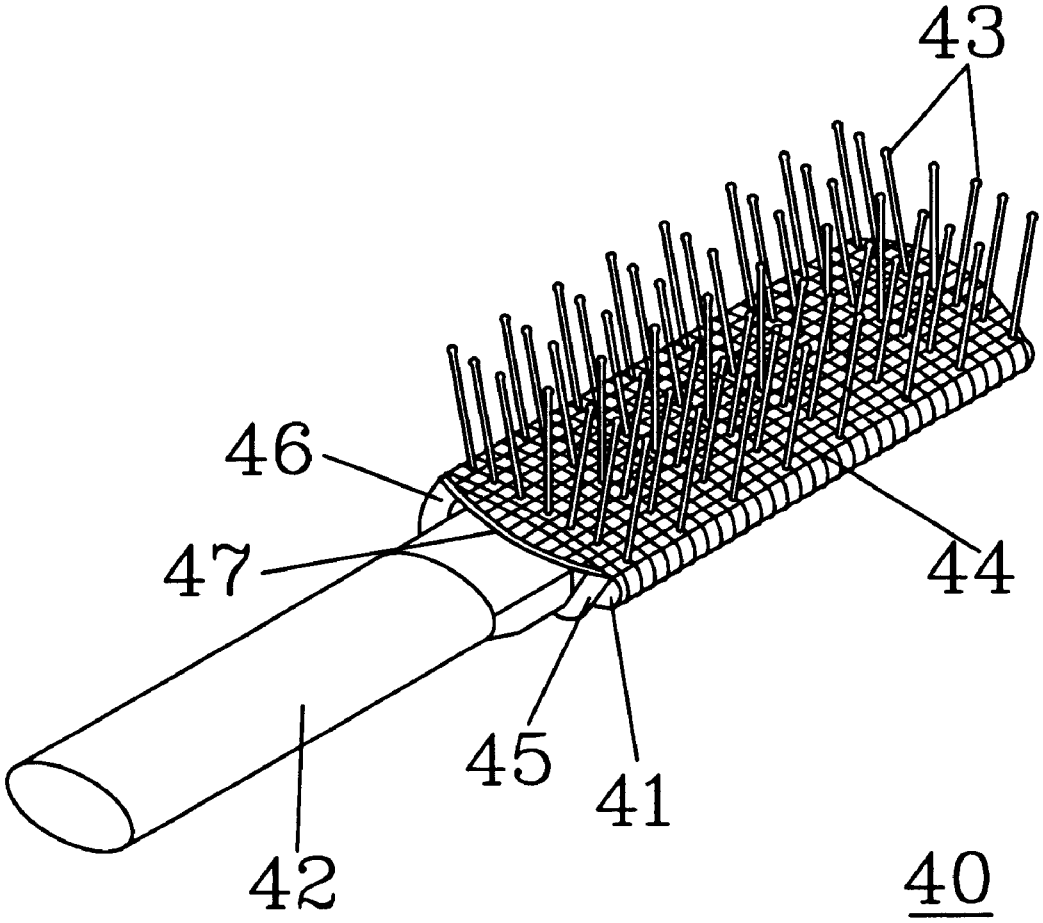
FIG. 5 is another brush embodiment and netting configuration.

FIG. 5 shows a brush 40 having a less dense bristle 43 configuration available on some brushes. Brush 40 has a handle 42 and body 41 on which a plurality of bristles 43 are spaced over the surface of body 41. A removable netting 44 is placed over body 41 with the bristles 43 extending upward out of netting 44. Netting 44 is held in place by an elastic band 47 which extends around the periphery of netting 44 and two bands 45 and 46 which extend around handle 42, similarly to the straps 19 and 20 illustrated in FIGS. 1 and 3.

The brush and netting configuration of the invention illustrated in FIGS. 1–5 illustrate an improvement over the prior art in that the netting can be placed over brushes of differing bristle configurations, and a guide plate is not necessary in order to replace the cleaning device such as the guide plate used in the prior art. The netting 16 and 44 of FIGS. 1–5 can be used with brushes with a high density of bristles as brushes 10 and 30 in FIGS. 1–4 and with brushes of a lesser density of bristles as shown in FIG. 5. The netting can be removed, cleaned and replaced, or new netting can be used at a low cost.

What is claimed:

1. A brush and netting combination providing a self-cleaning brush, comprising:

a brush having a base with a front and back side;

a handle extending from said base;

a plurality of bristles extending from the front side of the brush base;

a netting having an elastic periphery, said netting placed over the brush base with the bristles extending through the netting, and the elastic periphery holding the netting in place by pulling the netting around the base; and two straps attached to the netting and extending around the brush handle for holding the netting in position.

2. The brush and netting according to claim 1, wherein said netting is flexible so to permit placing the netting between dense brush bristles.

3. The brush and netting according to claim 1, wherein said straps are connected together by one of a buckle, snaps, and hook and loop fastener.

4. A brush and netting combination providing a self-cleaning brush, comprising:

a brush having a base with a front and backside;

a plurality of bristles extending from the front side of the brush base;

a netting having an elastic periphery, said netting placed over the brush base with the bristles extending through the netting; and the elastic periphery and two straps attached to the netting holding the netting in place around the brush.

5. The brush and netting to claim 4, wherein said netting is flexible so to permit placing the netting between dense brush bristles.

* * * * *